United States Patent [19]

Maroney

[11] Patent Number: 4,648,602

[45] Date of Patent: Mar. 10, 1987

[54] DICE GAME APPARATUS

[76] Inventor: Ralf P. Maroney, P.O. Box 2-151, Milford, Conn. 06460

[21] Appl. No.: 789,944

[22] Filed: Oct. 21, 1985

[51] Int. Cl.[4] ..... A63F 9/04; A47B 97/04; A47B 35/00

[52] U.S. Cl. ..... 273/146; 108/50; 312/230; 273/240; 273/148 R; 273/DIG. 26

[58] Field of Search ..... 273/309, 240, 146, DIG. 26, 273/3 R, 3 A, 85 R, 8, 14, 138 R, 148 R; 108/50, 24; 312/230

[56] References Cited

U.S. PATENT DOCUMENTS

| | | | |
|---|---|---|---|
| 803,520 | 10/1905 | Arney | 273/123 R |
| 863,412 | 8/1907 | Macrum | 273/DIG. 26 |
| 2,178,435 | 10/1939 | Robinson | 273/148 R |
| 2,222,985 | 11/1940 | Markell | 273/309 |
| 4,239,221 | 12/1980 | Griffin | 273/146 |

*Primary Examiner*—Richard C. Pinkham
*Assistant Examiner*—Gary Jackson
*Attorney, Agent, or Firm*—Allen D. Brufsky

[57] ABSTRACT

A dice box in the shape of a bowl is provided with sloping side walls terminating in a planar bottom surface. The side walls and bottom surface are covered with mohair, felt or other similar covering. A horizontal planar rim of substantial width has discrete portions connected to each side wall of the box. The number of sidewalls and rim portions are selected in accordance with the maximum number of players which can use the apparatus to participate in a game and are formed from a material which can be written upon and erased, such as slate. Up to ten dies are provided along with writing instruments susceptible to being used with the particular writing surface rim portions and an eraser. Two or more dies are thrown into the dice box by the players and scores recorded on the rim portion of the dice box assigned to each player in accordance with their dice thrown until the game is completed in accordance with predetermined rules. As a score changes or after the game is completed, each writing surface is erased and thus made ready for the next score to be recorded or game use.

8 Claims, 5 Drawing Figures

DICE GAME APPARATUS

BACKGROUND OF THE INVENTION

1. Field of the Invention

This invention relates to a game apparatus, and more particularly, a game apparatus for playing a plurality of dice games or games of chance using more than one die cube.

2. Description of Prior Art

Dice have been the foundation of many games. Most recently, dice have been used primarily in board games where playing pieces or "men" are moved about a game board in accordance with the number appearing on a thrown set of dice or die cubes. "Backgammon" is an example of such a game.

Other types of dice games rely strictly on the probabilities of certain numbers appearing on the dice, when thrown. A common dice game appearing in gambling casinos, known as "Craps", relies on this principle. In "Craps" wages are made on various dice combinations on any throw or series of throws on a felt-covered table bearing indicia representing the wager. The dice are thrown on the table, which usually has a rail about it and is in the shape of a rectangular planar surface with upright walls terminating in a peripheral rail. Chips representing the wager are placed on the indicia by a player or players and the dice are thrown on the table by a player designated as the "shooter" or "roller".

While the number and variety of dice games are virtually unlimited, none are known which employ game apparatus including means providing a surface on which the dice are rolled in combination with a plurality of writing surfaces surrounding the surface for recording comparison scores of all the players participating in the game. The apparatus of the present invention meets this criterion.

SUMMARY OF THE INVENTION

In accordance with the invention, a dice box in the shape of a bowl is provided with sloping side walls terminating in a planar bottom surface. The side walls and bottom surface are covered with mohair, felt or other similar covering. A horizontal planar rim of substantial width has discrete portions connected to each side wall of the box. The number of sidewalls and rim portions are selected in accordance with the maximum number of players which can use the apparatus to participate in a game and are formed from a material which can be written upon and erased, such as slate. Up to ten dies are provided along with writing instruments susceptible to being used with the particular writing surface rim portions and an eraser. Two or more dies are thrown into the dice box in turn by the players and scores recorded on the rim portion of the dice box assigned to each player in accordance with their dice thrown until the game is completed in accordance with predetermined rules. As a score changes or after the game is completed, each writing surface is erased and thus made ready for the next score to be recorded or game use.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 4:
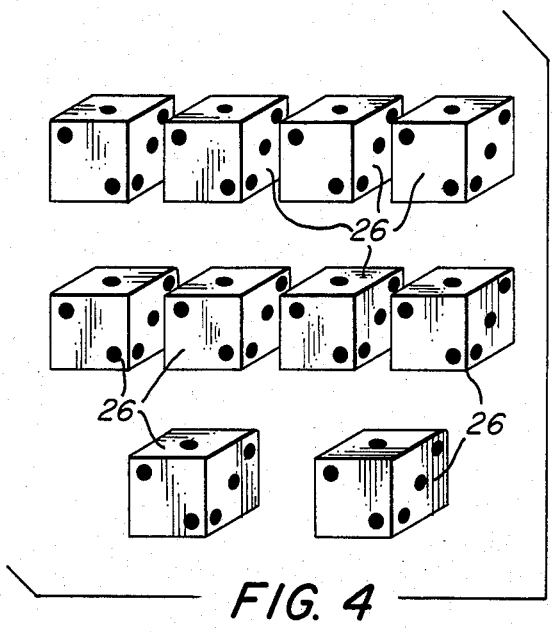
FIG. 4 is a perspective view of a number of die cubes comprising another portion of the dice game apparatus of the present invention.
Figure 5:
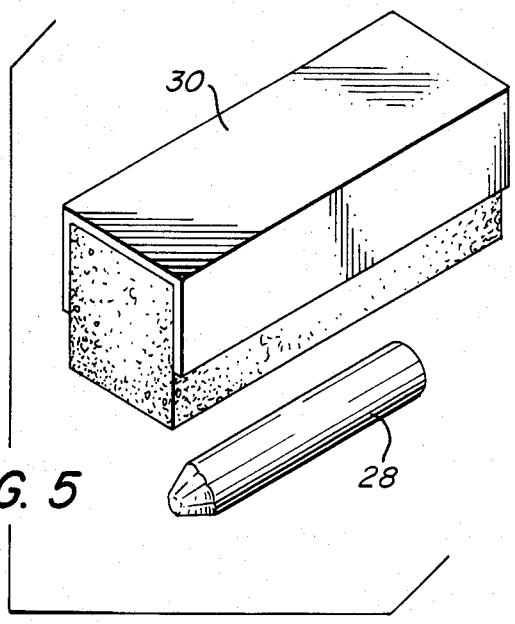
FIG. 5 is a perspective view of a piece of chalk and an eraser comprising another portion of the dice game apparatus of the present invention.
Figure 1:
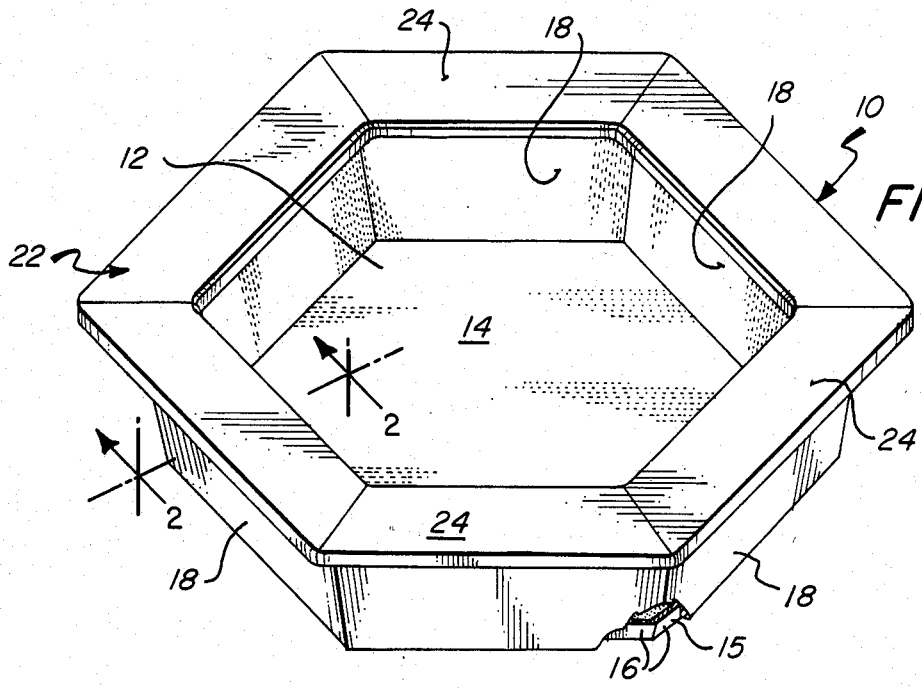
FIG. 1 is a perspective view of a bowl or receptacle comprising a portion of the dice game apparatus of the present invention.

Referring now to the drawing in detail, wherein like numerals indicate like elements throughout the several views, the dice game apparatus 10 of the present invention includes a bowl 12 having a planar bottom surface 14 formed from plywood, oak or other wood or plastic, shaped in the form of a polygon having sides 15 equal in number to the maximum number of players contemplated as using the apparatus 10. For purposes of illustration, planar bottom surface 14 is provided with six side edges 15, or is hexagonal in plan.

Figure 2:
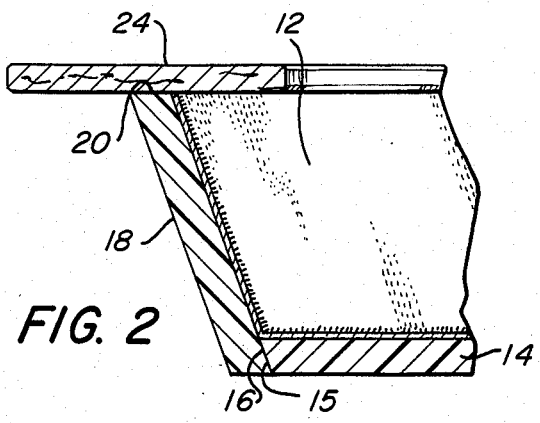
FIG. 2 is a cross-sectional view taken substantially along the plane indicated by line 2—2 of FIG. 1.
Figure 3:
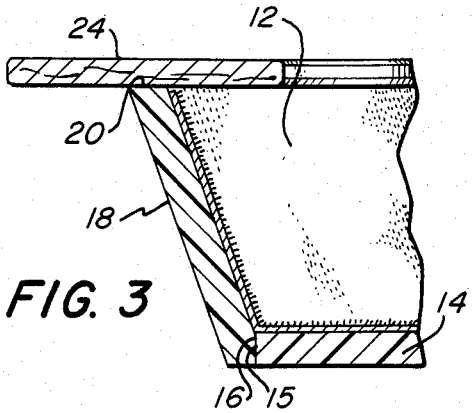
FIG. 3 is a cross-sectional view similar to FIG. 2, but illustrating an alternate receptacle construction.

Each side edge 15 of the bottom surface 14 has an upright (FIG. 2) or sloping surface 16 (FIG. 3) joined by adhesive or suitable fasteners (not shown) to a sloping sidewall 18 extending upwardly from the bottom surface. The side edges 19 of each sidewall 18 are joined to form a bowl 12. The interior surface of bottom surface 14 and sidewalls 18 are provided with a mohair, felt or similar covering.

Secured to the top edges 20 of each sidewall 18 is a horizontal rim 22 having individual, discrete pieces of slate 24 or other writing surface material joined at lateral abutting edges. The number of slate pieces 24 is equivalent to the number of sidewalls 18 or maximum number of players which can participate in a game to be played with apparatus 10.

In addition to bowl 12, the dice game apparatus 10 includes ten individual dies 26, chalk 28 and a chalk eraser 30. While the preferred material of the rim 22 is slate, it should be understood that any comparable material which will receive writing and can be erased may be used, such as a plastic surface on which crayon can be reproduced and erased or the like.

A number of different dice games utilizing the apparatus 10 can be played, in accordance with the following rules:

TITLE: OH DARN!

Number of Players: Unlimited

Number of Dice: 3

A game particularly well suited for wagering. The first player to reach 2100 points wins the wager. The last player to reach 2100 pays the wager.

Objective: To be first to reach an exact score of 2100 points.

Start: Each player rolls 3 dice. The highest scorer starts; play proceeds clockwise.

Play:

I. Ground Rules

A. A 1=100 points

B. A 5=50 points

C. You must accumulate 500 points before you may begin recording and adding to your score on your slate rim portion which is assigned to you.

D. You must reach exactly 2100 points; you may not go over.

E. Three 1's=1000 points if your current score is less than 1100.

F. Three 5's=500 points if your current score is less than 1600.

G. If you roll three 1's or three 5's, you may have one free roll without the risk of losing your accumulated points.

II. During the Game

A. You may continue your turn as long as you like provided that each roll contains at least a 1 or a 5.

B. If a roll does not contain either a 1 or a 5;

1. you lose your turn
2. you lose all points accumulated *during that turn only;* you keep points earned during previous turns once you have passed a score of 500.

C. As you approach 2100 points, 1. you may accept only those rolls that will not give you more than 2100
2. you lose your turn if your roll brings you over 2100.

Strategy Notes:

Don't be greedy and try to accumulate too many points during one turn, even if your opponents are far ahead of you. It often takes many turns to roll exactly the number of points needed to reach 2100 and the chances are good that you will catch up to them before they are able to go out.

TITLE: CENTENNIAL

Number of Players: Up to 6

Number of Dice: 3

Objective: To be the first to roll the numbers 1 to 12 and then 12 to 1 in order.

Start: The highest roller of three dice begins.

Play:

I. Set Up

A. Write the numbers 1 to 12 and 12 to 1 on your Dice Box scoring ledge or rim portion:

1 2 3 4 5 6 7 8 9 10 11 12

12 11 10 9 8 7 6 5 4 3 2 1

II. The Game

A. Roll 3 dice

1. If a 1 shows, cross out your first 1 on the scoring ledge.
2. If no 1 is rolled, play passes to the next player.

B. Numbers must be crossed out in order.

C. More than one number may be crossed out in a turn

1. If you roll a 1 and a 2 on your first roll, both may be crossed out.

D. The dice may be added to eliminate numbers

1. If your first roll was 1-1-3, you could eliminate:
   a. 1
   b. 2 (1+1=2)
   c. 3
   d. 4 (1+3=4)
   e. 5 (1+1+3=5)

E. Your turn continues until you are unable to eliminate the next number in your sequence.

Variation:

You may cross out the numbers in any order on the 1 to 12 list and then on the 12 to 1 list, but you may use each of the 3 dice only once in each turn to calculate your score. Therefore, on a roll of 1-1-3, you could eliminate:

1 and 3
1 and 4 (3+1)
2 (1+1) and 3

TITLE: PIG

Number of Players: Up to 6

Number of Dice: 2

The point of PIG is not to be one; if you get too greedy, you may never win the game.

Objective: To be the first to reach a score of 100 points.

Start: The highest roller of 2 dice starts.

Play:

I. Ground Rules

A. A roll containing a 1 is not counted unless you roll double 1's.

B. If you roll a 1, you lose all points accumulated *during that turn only;* you keep all points accumulated during previous turns.

C. You may continue your turn as long as you wish provided your roll does not contain a 1.

D. Your score is calculated by adding the values of the two dice.

E. If you throw a double, your score for that roll is doubled

1. A throw of two 2's=8 points (twice 4 points)
2. A throw of two 6's=24 points (twice 12 points)

F. A throw of double 1's=25 points and you may continue your turn.

II. The Game

A. Continue rolling your 2 dice until

1. You elect to stop and record your score for that turn.
2. You roll a 1, in which case you lose your points for that turn.
3. You reach 100 points or more.

B. A winner is declared only at the end of a completed round.

1. If your final roll gives you 104 points, but the next player scores 107, you lose.

C. Once you reach 100 points, you may not roll again.

TITLE: DOUBLES

Number of Players: Up to 6

Number of Dice: 2

A good game for wagering. First to go out wins the wager; last to go out pays the wager.

Objective: To reach an exact score of 0 and retire from the game.

Start: Highest roller of 2 dice starts. All players write the number 201 on their scoring ledges. If you are playing for money, everyone antes an agreed-upon amount into the Pot.

Play:

I. Ground Rules

A. You must move from a starting score of 201 to an exact score of 0.

B. You have one roll per turn.

C. You must throw a double to begin scoring.

D. All doubles are worth the value of the number squared;
1. A roll of double 5's=25 points.
E. After your initial doubles roll, *all* rolls score;
1. Scores are determined by adding the values of the 2 dice rolled unless you throw doubles.
2. Doubles scores continue to be squared throughout the game.
F. When you reach a score of 6 or less, you throw only 1 die until you go out.

II. The Game
A. Write the number 201 on your Dice Box scoring ledge.
B. If you do not throw a double on your first roll, play passes to the left and you do not score.
C. Once you have rolled a double, compute your score and subtract it from the 201 on your scoring ledge.
D. For each subsequent roll, add the values of your dice and subtract from your score unless you roll doubles; then square the value before subtracting.
E. When your score reaches 6 or less, toss only 1 die.
F. You must reach an *exact* score of 0 to go out.
1. If your score is 1, you must roll a 1 to go out.
2. If your score is 36 and you roll double 6's, you go out.
3. If your score is 24 and you roll double 5's, you lose your turn because a score of 25 would put you below 0.

TITLE: GUTS

Number of Players: Up to 6

Number of Dice: 4

Objective: To roll a score that falls between your upper and lower limits.

Start: Each player antes a predetermined amount into the Pot. The highest roller of 2 dice starts the first game and the player to the left of the starter is Pot Watcher. The Pot Watcher is responsible for keeping track of the amount in the Pot at all times by writing the figure on a corner of the scoring ledge. The positions of first player and Pot Watcher rotate to the left after each completed game.

Play:

I. Set Up
A. Each player in turn rolls 4 dice to establish individual upper and lower limits, which are written on the Dice Box scoring ledge.
1. The values of the 2 lowest dice are added to establish the lower limit.
2. The values of the 2 highest dice are added to establish the upper limit.
B. Only if impossible limits are rolled may you reroll until possible limits are established.
1. A roll of 4 of a kind=impossible limits.
2. A roll resulting in limits that are 1 number apart, such as 6–7, =impossible limits.
3. A roll resulting in limits 2 or more numbers apart, such as 6–8=possible limits and *must* be accepted.
4. You may *not* reroll limits you do not like; you may reroll *only* when impossible limits exist.
C. You have one roll per round.
D. The game ends when the Pot is empty.
1. Players ante again
2. First player position moves to the left.
3. The player to the left of the first player becomes Pot Watcher.
E. A game continues as long as there is money in the Pot, but players roll new limits after each round—that is, after each player has had one turn with that pair of limits.

II. The Game
A. Place your bet according to how good you think your chances are of rolling a total with 2 dice that will fall between your limits.
1. You may bet any amount *up to* the amount contained in the Pot.
2. You must bet at least the amount of your ante.
B. Roll 2 dice.
1. If the total rolled falls between your upper and lower limits, you win your bet from the Pot.
2. If the total rolled does not fall between your limits, you lose your bet to the Pot.
C. Continue the game, rolling new limits after each round, until someone wins the entire Pot.

Variation:

After each game, the position of first player moves to the left of the person who won the last game. The position of Pot Watcher moves to the left of the new first player.

TITLE: QUALIFY

Number of Players: Up to 6

Number of Dice: 5

Objective: To accumulate a minimum of 25 points in 5 rolls of the dice.

Start: The highest roller of 2 dice is Banker for the first round; player to the left of the Banker starts. At the completion of a round, the position of Banker moves to the left.

Play:

I. Ground Rules
A. Players place their bets with the Banker and note the amount on the Dice Box scoring ledge.
B. Each turn consists of 5 rolls.
1. Only the highest die of each roll counts in the scoring.

II. Procedure
A. Roll 5 dice.
B. Set aside the highest die and roll the remaining 4.
C. Set aside the highest die and roll the remaining 3.
D. Set aside the highest die and roll the remaining 2.
E. Set aside the highest die and roll the remaining 1.
F. Calculate the sum of the 5 highest dice rolled.
1. If the sum is less than 25, you lose your bet to the Banker.
2. If the sum is 25 or greater, you qualify for a pay off from the Banker.

III. Pay Off
A. The amount of your pay off is determined by the number of times your Pay Number appears in your Pay Off Roll.
1. Pay Off Roll=a final roll of all 5 dice.

| 2. Pay Number = | Total for 5 Rolls |
|---|---|
| 1 | 25 |
| 2 | 26 |
| 3 | 27 |
| 4 | 28 |
| 5 | 29 |
| 6 | 30 or more |

3. You collect from the Banker an amount equal to your original bet for each die in the Pay Off Roll showing your Pay Number.
4. If your Pay Off Roll does not produce *any* die showing showing your Pay Number, you lose your stake to the Banker.

B. Examples
1. Score=25; Pay Number=1; Pay Off Roll=two 1's; you collect at 2 to 1, or twice your original bet.
2. Score=29; Pay Number=5; Pay Off Roll=-three 5's; you collect at 15 to 1 odds, or 15 times your original bet.
3. Score=27; Pay Number=3; Pay Off Roll=NO 3's; you lose your bet to the Banker.

TITLE: ENGINEERS DICE

Number of Players: Up to 6

Number of Dice: 2

A good memory and reasonable math skills are needed here.

Objective: To achieve the highest score from a total of 4 rolls per turn. Highest scorer in each round wins.

Start: Any player may begin.

Play:

I. Ground Rules
A. Each turn consists of 4 rolls.
B. On the first roll, both dice are used to calculate your score.
C. On the second, third, and fourth rolls, both dice are rolled but only one is used to calculate the new score.
D. In each turn, you must add, subtract, multiply and divide as you compute your score.
1. You may do the computations in any order you wish.
2. You may use each computation only *once* in each turn.
3. You *must* use each computation once in each turn.

II. Procedure
A. First roll=6 and 1. Using *both* dice, you choose to divide 6 by 1, thus scoring 6.
B. Second roll=5 and 2. You choose to use the 5 and add it to your previous score of 6 for a total of 11.
C. Third roll=3 and 2. You choose to use the 2 and subtract it from your previous score of 11 for a total of 9.
D. Fourth roll=4 and 6. You choose to use the 6, and you *must* multiply (it's the only computation you have left) it times your previous score of 9 for a final score of 54.

Strategy Note:

Try to save your "divide" turn for a roll that includes a 1. That way your score is not reduced.

TITLE: BATTLESHIP

Number of Players: Up to 6

Number of Dice: 5

Objective: To be the first to reach 100 points or to score the highest number of points in 10 rounds of play.

Start: The lowest roller of 5 dice starts.

Play:

I. Ground Rules
A. You may have up to 3 rolls each turn.
B. You must roll the following *in order:*
1. 6=your ship
2. 5=your captain
3. 4=your mate
4. sum of the remaining dice=your crew.
C. If your first roll does not produce a 6, all 5 dice are rerolled.
D. If a 6 is thrown, it is set aside and the remaining dice are rolled.
E. If a 6 and a 5 are thrown together, both are set aside and the remaining 3 dice are thrown to get a 4 (mate).
F. After the ship (6), captain (5), and mate (4) have been set aside, roll the remaining 2 dice to get your crew if any of your 3 allowed rolls remains.

II. Procedure
A. If you get a 6, 5, and 4 on your first roll, you have two rolls left to get the highest score for your crew.
1. You may reroll one or both of the remaining dice.
2. You may choose not to roll again at all.
B. If you get a 6 and a 5 on your first roll and 4 on your second roll, you have one roll remaining.
C. If you get a 6 on your first roll, a 5 on your second, and a 4 on your third, you *must* use the value of the two dice remaining when you set aside your 4 because you have used up all three of the rolls allowed in one turn.
D. If you do not produce a 6, 5, and 4 in order during your three rolls, you do not score for that turn.

III. Scoring
A. You do *not* score any points for the ship, captain, or mate.
B. If you have succeeded in acquiring a ship, captain, and mate, you score one point for each crew member acquired—that is, the value of the last 2 remaining dice.

TITLE: DROP DEAD

Number of Players: Up to 6

Number of Dice: 5

Objective: To achieve the highest score in 5 rounds.

Start: Any player may start; play proceeds clockwise.

Play:

I. Ground Rules
A. A game consists of 5 complete innings.
B. Scores are counted only on those rolls that do *not* contain any 2's or 5's.
C. When any 2's or 5's are rolled, they are removed and the remaining dice are rerolled.

II. The Game
A. Roll all 5 dice.
B. If any 2's or 5's show, remove them.
1. No score is counted on this roll.
C. Reroll the remaining dice until neither a 2 nor a 5 shows, removing all 2's and 5's as they appear.
D. Keep a running score of the total value of all dice on all rolls containing *no* 2's or 5's on the Dice Box scoring ledge.
E. Continue your turn until all the dice have come up 2 or 5 and have been removed, and you have "dropped dead".
F. Continue the game until all players have completed 5 innings.

TITLE: POKER DICE

Number of Players: Up to 6

Number of Dice: 5

Played under the same circumstances in which you would choose to play regular poker.

Objective: To achieve the best poker hand.

Start: The highest roller of 2 dice starts.

Play:

I. Ground Rules
- A. You may roll the dice twice in each turn.
- B. You may set aside some dice from the first roll and reroll the remaining dice for your second toss.
- C. Ace is high.
  - 1. Number rank in descending order is 1-6-5-4-3-2.
- D. If 2 or more players roll hands of equal rank, the highest-numbered hand wins.
  - 1. Four 4's beats four 3's.
- E. The values of dice not used to figure the rank of a hand are NOT used to break a tie.
  - 1. Four 4's and a 3 are considered a tie with four 4's and a 6.
  - 2. Ties are broken by rerolling the dice.

II. Rank Order of Poker Hands
- A. 5 of a kind
- B. 4 of a kind
- C. Full house (3 of a kind+a pair)
- D. High Straight (2-3-4-5-6)
- E. Low Straight (1-2-3-4-5)
- F. 3 of a kind
- G. 2 pair
- H. 1 pair III. Variations
- A. Aces or deuces may be considered "wild".
- B. Each player may be permitted up to 3 rolls a turn instead of 2.

TITLE: TWENTY-SIX

Number of Players: Up to 6

Number of Dice: 10

Objective: To throw a selected number at least 26 times in 13 rolls of 10 dice, or exactly 13 times, or fewer than 11 times.

Start: The highest roller of 2 dice is Banker for the first round; the player to the Banker's left begins. After each round is completed, the position of Banker moves to the left.

Play:

I. Set Up
- A. Place your bet and note the amount on the Dice Box scoring ledge.
- B. Select a number from 1 to 6 and post it on the scoring ledge.
- C. Roll the 10 dice 13 times.
  - 1. Note the number of times your selected number appears in each roll on the scoring ledge.
- D. At the end of your 13 rolls, tally your score.

II. Scoring
- A. If your total is 26 or more, you win your bet.
- B. If your total is exactly 13, you win your bet.
- C. If your total is 10 or less, you win your bet.
- D. If you lose your bet, the Banker collects that amount from you.

III. The Pay Off

| Player's Total | Pay Off On Bet |
|---|---|
| 26 | 4 to 1 |
| 27 | 5 to 1 |
| 28 | 6 to 1 |
| 29 | 8 to 1 |
| 30 or more | 10 to 1 |
| 13 | 5 to 1 |
| 10 or less | 10 to 1 |

Thus, if you rolled your selected number 28 times and your bet was $5, your pay off would be at 6 to 1 odds, or $30.

TITLE: BUCK DICE

Number of Players: Up to 6

Number of Dice: 3

Objective: To reach exactly 15 points and retire from the game.

Start: The highest roller of 3 dice begins. The lowest roller of 3 dice tosses 1 die to establish the Point Number for the game.

Play:

I. Ground Rules
- A. If your roll contains the Point Number, you score a point for each Point Number showing.
- B. If your roll does not contain the Point Number, play passes to the next player.
- C. You must go out with *exactly* 15 points.
  - 1. If your score is 14 and your next roll contains 2 dice showing the Point Number, you lose your turn.
- D. Keep a running score on your Dice Box scoring ledge.

II. Bonus Rolls
- A. Triplets of the Point Number=BIG BUCK.
  - 1. You automatically score 15 points regardless of your previous score and retire from the game.
- B. Triplets of any of the other 5 numbers=LITTLE BUCK.
  - 1. You score 5 points and continue your turn.
  - 2. If you have 11 or more points, you cannot use LITTLE BUCK because your score would then exceed 15; you do not score and play moves to the next player.

TITLE: TWENTY-ONE

Number of Players: Up to 6

Number of Dice: 2

The dice equivalent of Blackjack.

Objective: To come closest to a score of 21 without going over.

Start: The highest roller of 2 dice starts.

Play:

I. Ground Rules
- A. Each player antes an agreed-upon amount into the Pot.
- B. You may roll the dice as many times as you wish during your turn.
  - 1. You may stand pat on any point total that is less than 22.
  - 2. Each time you roll, your score is added to that of your last roll on the Dice Box scoring ledge.
  - 3. When you reach a total score of 14 or more, you switch to 1 die.
  - 4. If your total exceeds 21, you have lost that game.

C. After all players have had their turns, the one closest to 21 without going over wins the Pot.

1. Ties are broken by rolling for 21 again.

2. The player who rolled last for a tie must roll first in the tie breaker.

D. The position of first roller moves to the left after the completion of each game.

II. Strategy

A. 17 or less=risk another roll.

B. 19 or more=stand pat unless someone else already has 20 or 21.

C. 18=an even chance of making 21 or going over.

The sloping sidewalls 18 enhance the various games by assuming that the thrown dice cubes 26 are assisted in turning in a random motion or fashion. Further, the bowl shape of the dice receptacle 12 contains the dice cubes within a confined, limited area for ready reuse.

What is claimed is:

1. Dice game apparatus including:

a plurality of dice cubes, at least one writing instrument for forming indicia on a writing surface, means for erasing indicia formed by said writing instrument, a bowl-like die receptacle for receiving a number of said die cubes randomly tossed into the interior thereof, a planar bottom surface shaped in the form of a polygon having side edges equal in number to the maximum number of players adapted to use the apparatus, a plurality of upright sidewalls connected to said planar bottom surface, and a continuous ledge having separately identifiable portions formed from material which can be written upon by said writing instrument seated on the top of each of said upright sidewalls for recording a score formed by said randomly tossed die cubes.

2. The apparatus of claim 1 wherein said side walls slope outwardly from said bottom surface towards said ledge.

3. The apparatus of claim 1 wherein said ledge is substantially horizontal.

4. The apparatus of claim 1 wherein said separately identifiable portions of said ledge are equal in number and extend to the top edge of each of said side walls.

5. The apparatus of claim 1 wherein the interior surface of said upright side walls and bottom planar surface are provided with a cloth covering.

6. The apparatus of claim 1 wherein said ledge is formed from slate.

7. The apparatus of claim 1 wherein said writing instrument is a piece of chalk.

8. The apparatus of claim 1 wherein each of said upright sidewalls is connected to a side edge of said planar bottom surface.

* * * * *